United States Patent [19]

Borel

[11] Patent Number: 4,463,782

[45] Date of Patent: Aug. 7, 1984

[54] SHEDDING APPARATUS FOR CIRCULAR WEAVING OF MULTI-HARNESS FABRICS AND METHOD OF USING THE APPARATUS

[75] Inventor: Georg Borel, Reutlingen, Fed. Rep. of Germany

[73] Assignee: Hermann Wangner GmbH & Co., KG, Reutlingen, Fed. Rep. of Germany

[21] Appl. No.: 352,421

[22] Filed: Feb. 25, 1982

[30] Foreign Application Priority Data

Mar. 4, 1981 [DE] Fed. Rep. of Germany ..... 3108189

[51] Int. Cl.[3] ..... D03C 13/00; D03D 49/14; D03D 37/00

[52] U.S. Cl. ..... 139/55.1; 139/13 R; 139/20; 139/97

[58] Field of Search ..... 139/13–16, 139/35, 55.1, 97, 115, 20, 408, 409

[56] References Cited

U.S. PATENT DOCUMENTS

| | | | |
|---|---|---|---|
| 763,628 | 6/1904 | Petersen | 139/97 |
| 2,173,163 | 9/1939 | Hale | 139/16 |
| 2,649,864 | 8/1953 | Mayer, Jr. et al. | 139/97 |
| 3,818,951 | 6/1974 | Greenwood | 139/20 |
| 4,046,170 | 9/1977 | Juillard et al. | 139/20 |
| 4,174,739 | 11/1979 | Rasero et al. | 139/408 |

FOREIGN PATENT DOCUMENTS

| | | | |
|---|---|---|---|
| 187444 | 7/1907 | Fed. Rep. of Germany | 139/97 |
| 1086197 | 8/1954 | France | 139/35 |

*Primary Examiner*—James Kee Chi

*Attorney, Agent, or Firm*—Sughrue, Mion, Zinn, Macpeak and Seas

[57] ABSTRACT

A shedding apparatus for the circular weaving of multi-harness fabrics includes a plurality of heddle frames for weaving a multi-ply screen of the type suitable for use with a paper making machine. Each heddle frame has a warp wire from each fabric half drawn therethrough and a divider wire is located between the heddle frames and the reed. The divider wire extends across the entire width of the fabric with all of the warp wires of the upper fabric half extending above the wire divider and all of the warp wires of the lower fabric half extending beneath the wire divider so that upon weaving of one fabric half the divider wire is raised or lowered so that the warp wires of the other fabric half are urged away from the shed by the wire divider. A compensator rod may be provided between the heddle frames and the warp beam to compensate for the tension placed on warp wires due to different path lengths for the warp wires as caused by the wire divider.

2 Claims, 15 Drawing Figures

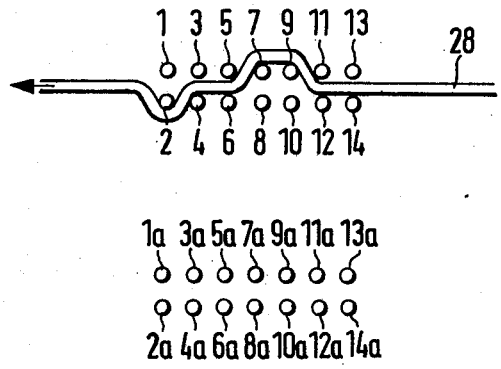
FIG. 6
FIG. 7
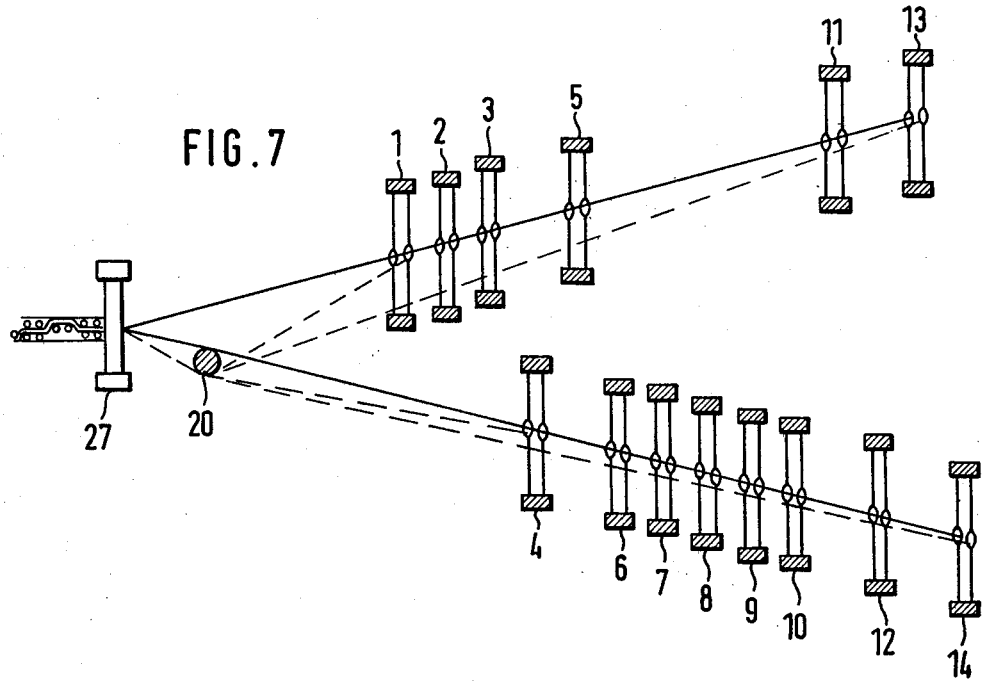

SHEDDING APPARATUS FOR CIRCULAR WEAVING OF MULTI-HARNESS FABRICS AND METHOD OF USING THE APPARATUS

BACKGROUND OF THE INVENTION

The present invention is directed to a shedding apparatus for the circular weaving of multi-harness fabrics and more specifically to a wire divider in the form of a rod extending across the entire fabric width and located between the first heddle frame and the reed which enables circular weaving with the same number of heddle frames as with flat weaving. The present invention is also directed to the method of using the apparatus.

In ordinary practice, the number of heddles of a fabric weave is limited by the number of heddle frames which can be accommodated in the apparatus. The number of heddle frames could not be increased as desired because with a given angle of shed opening, the lift of each additional heddle frame would become extraodinarily great. This is particularly true for circular weaving looms having a great number of heddles since the weft wire is passed alternately through the upper fabric half and through the lower fabric half so that twice the number of heddles is required. For example, in a 7-harness weave, 14 heddle frames would be required. The difficulties grow for the circular weaving of multi-ply fabrics, for example multi-ply screens for paper making machines. For example, 28 heddle frames would be required for the circular weaving of a two-ply screen for a paper making machine having a 7-harness weave according to conventional methods. However, modern looms for the circular weaving of screens for paper making machines have only 17 heddle frames at the most.

SUMMARY OF THE INVENTION

The present invention provides a new and improved shedding apparatus for the circular weaving of multi-harness fabrics which enables circular weaving with the same number of heddle frames as with flat weaving. This is accomplished by the use of a wire divider in the form of a rod extending across the entire fabric width and located between the first heddle frame and the reed. Means are provided for lifting and lowering the wire divider upon each change of shed with the wire divider in its extreme upper and lower positions being disposed outside of or at best at the border of the shed opening. Each heddle frame carries for each weave repeat both a warp wire of the upper fabric half and a warp wire of the lower fabric half with all warp wires of the upper fabric half extending above the wire divider and all warp wires of the lower fabric half extending beneath the wire divider so that during weaving of one fabric half, the warp wires at the other fabric half are urged away by the wire divider.

The advantages attainable by the present invention reside in the fact that the number of heddle frames required is the same as if the fabric were woven flat, namely the number of plys times the number of warp wires of one ply per pattern repeat. Since the warp wires of the lower and upper fabric halves are drawn in each heddle frame the same heddle frames serve for weaving both the upper and lower fabric halves. The use of the present invention is not limited to two-ply or multi-ply screens, but is also applicable to single-ply circularly woven fabrics. The term "wire" as used herein designates metallic as well as plastic monofilaments and multifilaments.

The foregong and other objects, features and advantages of the present invention will be apparent from the following more particular description of a preferred embodiment of the invention as illustrated in the accompanying drawings.

BRIEF DESCRIPTION OF THE DRAWINGS

FIG. 6 is a schematic diagram similar to FIGS. 2 and 4 showing the subsequent passage of the weft wire through the upper fabric half.

FIG. 7 is a schematic view showing the positions of the heddle frames during the passage of the weft wire shown in FIG. 6.

DETAILED DESCRIPTION OF THE INVENTION

Figure 1:
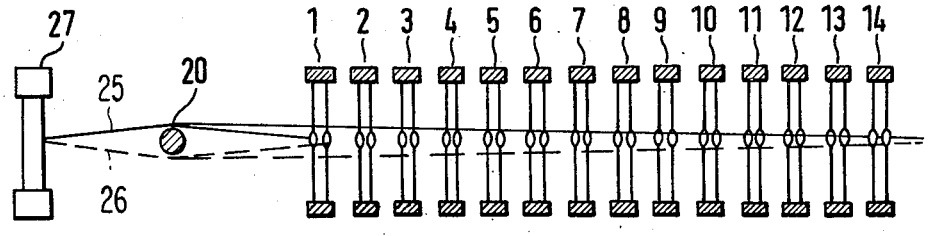
FIG. 1 is a schematic view showing the drawing of the warp wires into the heddle frames and the course of the warp wires above and beneath the wire divider.

The shedding apparatus according to the present invention, is set-up, by way of example, for weaving a two-ply screen for a paper making machine wherein the screen is woven in a 7-harness weave of the longitudinal wires (weft wires). To this end, the shedding apparatus is comprised of 14 heddle frames each having two heddles for each pattern repeat of the warp, namely one heddle each for each pattern repeat of the upper and lower screen halves 25 and 26, respectively. The heddle frames thus contain twice the usual number of heddles 24. However, instead of that, each heddle 24 may have two heddle holes as the two warp wires may extend through the two heddle holes respectively. Before the first heddle frame, that is between the heddle frame 1 and the reed 27, a wire divider 20 is provided which in the most simple embodiment consists of a rod extending across the entire width of the loom. The wire divider 20 is movable between upper and lower positions and in its upper and lower positions is at the boarder of the shed opening angle. Upon each shed change it is moved from one position to the other position, for example by pneumatic, hydraulic or other mechanical or electromagnetic means essentially corresponding to the means for lifting and lowering the heddle frames 1–14. As shown in FIG. 1, the warp wires of the upper screen half 25 which are illustrated by full lines are inserted so that they extend above the wire divider 20 and the warp wires of the lower screen half 26 illustrated by broken lines are inserted so that they extend beneath the wire divider 20. In its lower position, the wire divider 20 therefore urges all the warp wires of the lower screen half 26 downwardly along with the warp wires drawn through a lifted heddle frame. Likewise, when the wire divider 20 is in its lifted position, it will lift all of the warp wires of the upper screen half 25 including those drawn through a lowered heddle frame.

Figure 2:
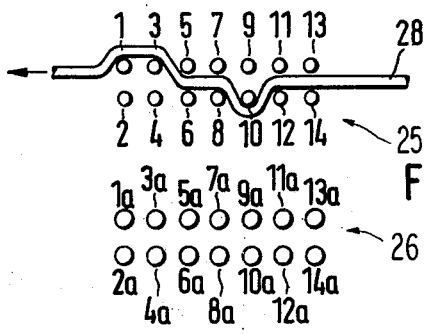
FIG. 2 is a schematic diagram showing the passage of one particularly weft wire through the upper fabric half.
Figure 3:
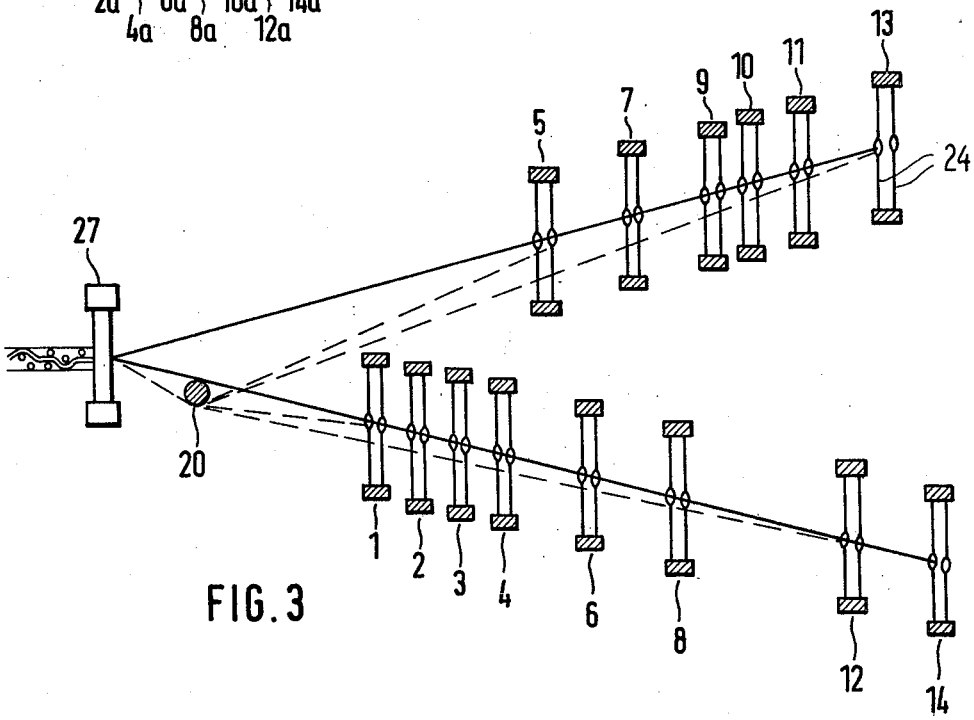
FIG. 3 is a schematic view showing the position of the heddle frames during the passage of the weft wire shown in FIG. 2.

FIG. 2 represents a section through the 28 warp wires of the selected example with the warp wires appearing as small circles. The warp wires in the upper two rows which are numbered 1 through 14 belong to a weave pattern repeat of the upper screen half 25 while the warp wires of the two lower rows numbered 1*a* through 14*a* being to a pattern repeat of the lower screen half 26. The warp wires of one row belong to one particular ply of the fabric. When a weft wire 28 is to be inserted in the manner shown in FIG. 2, the respective heddle frames are lifted or lowered according to the desired pattern as shown in FIG. 3 so that the warp wires 1 and 1*a* of FIG. 2 pass through the heddle frame 1 of FIG. 3, the warp wires 2 and 2*a* of FIG. 2 pass through the heddle frame 2 of FIG. 3, etc. Hence, a warp wire of the upper screen half 25 and the corresponding wire of the lower screen half 26 are drawn through each heddle frame. Since the weft wire 28 is to pass over the warp wires 1–4, 6, 8, 12 and 14 as shown in FIG. 2, these heddle frames are lowered as shown in FIG. 3 while the other heddle frames are lifted since the weft wire 28 is to pass beneath the remaining warp wires. Although the warp wires 5*a*, 7*a*, 9*a*, etc. of the lower screen half 26 pass through the heddle frames 5, 7, 9, etc. which are lifted in FIG. 3, the weft wire 28 nevertheless does not pass underneath said warp wires because the wire divider 20 as shown in FIG. 3 is in its lowered position so that all the warp wires of the lower screen half 26 are urged downwardly and the weft wire 28 passes over all the warp wires of the lower screen half 26.

Figure 4:
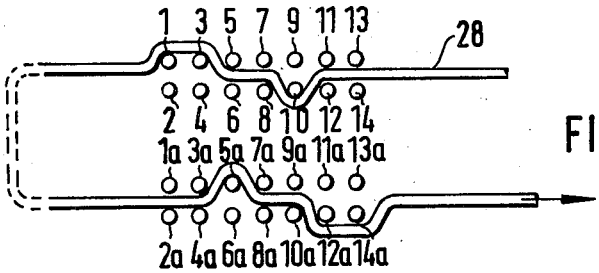
FIG. 4 is a schematic diagram similar to FIG. 2 showing the subsequent passage of the weft wire through the lower fabric half, that is the return path of the weft wire shown in FIG. 2.
Figure 5:
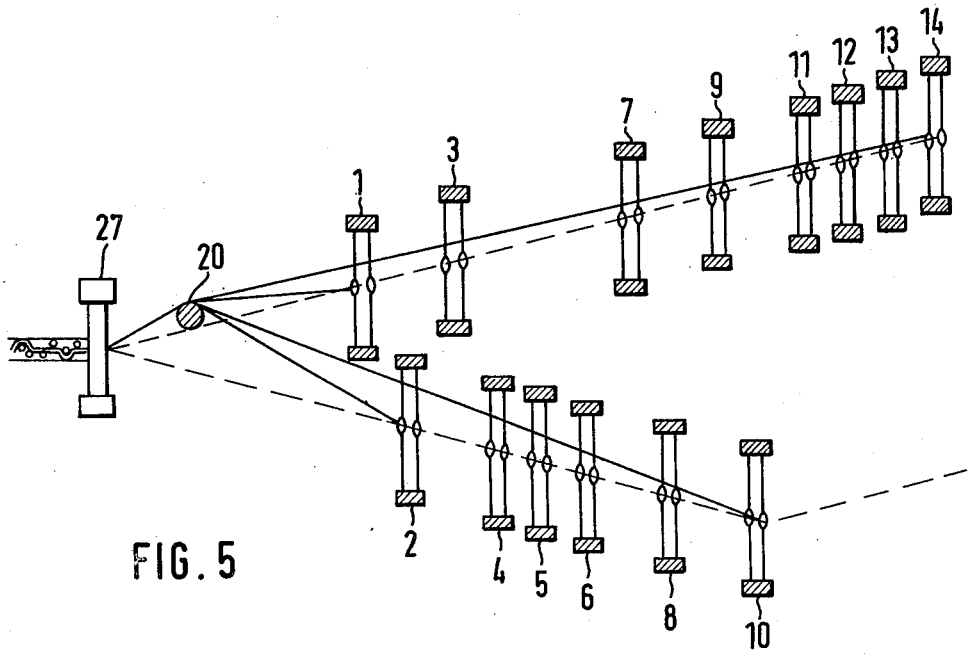
FIG. 5 is a schematic view showing the positions of the heddle frames during the passage of the weft wire through the lower fabric half shown in FIG. 4.

FIG. 4 shows a subsequent passage of the weft wire 28 through the lower screen half and FIG. 5 shows the respective positions of the heddle frames and the wire divider corresponding to the desired course of the weft wire 28. As clearly shown in FIG. 5, the shed is now formed in the lower half of the screen. The wire divider 20 is in its lifted position thereby urging all the warp wires of the upper screen half 25 upwardly so that the weft wire 28 passes underneath all the warp wires of the upper screen half 25.

As is customary in circular weaving, the weft wire 28 is now inserted again into the upper screen half 25. In the selected examples, the weft wire 28 shall take the course as illustrated in FIG. 6 which requires the positioning of the heddle frames as shown in FIG. 7. The wire divider 20 is again disposed in its lowered position urging all the warp wires of the lower screen half 26 downwardly. Hence, the wire divider 20 is in its lowered position when the weft wire is introduced into the upper fabric half 25 and it is in its lifted position when the weft wire is introduced into the lower fabric half 26.

A three-ply or generally multi-ply fabric is woven in precisely the same way as described for two-ply fabrics. Each heddle frame is provided with twice the number of heddles with one half of the heddles being provided for the upper fabric half 25 and the other half of the heddles for the lower fabric half 26.

Figure 8:
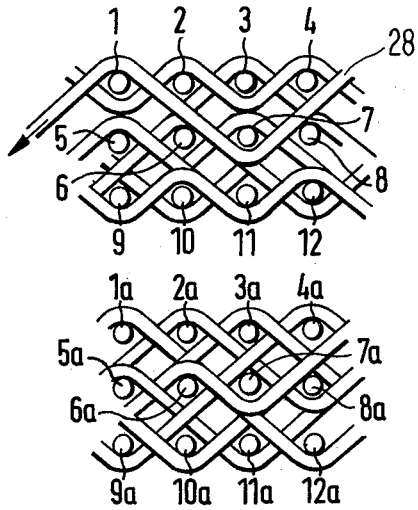
FIG. 8 is a schematic diagram showing the passage of one particular weft wire during the weaving of a three-ply fabric.
Figure 9:
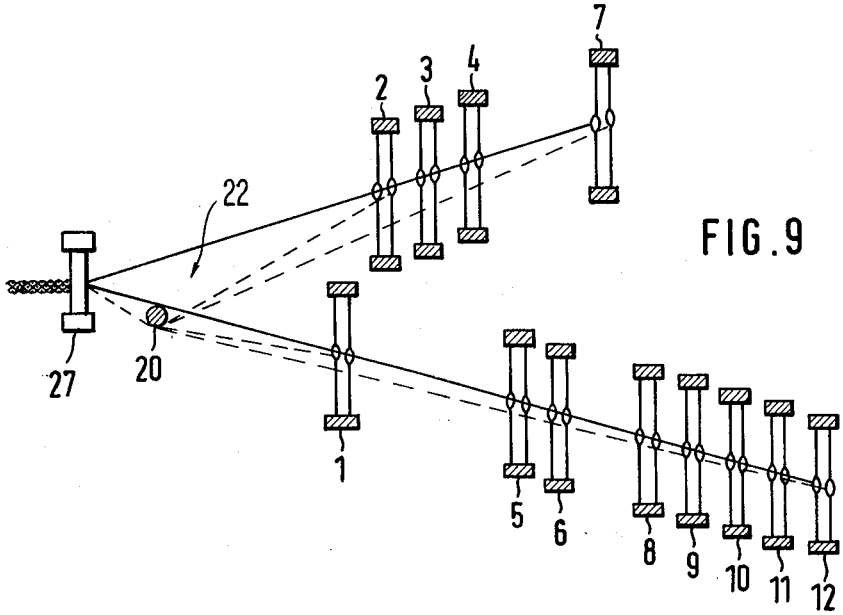
FIG. 9 is a schematic view showing the positions of the heddle frames during the passage of the weft wire shown in FIG. 8.

FIG. 8 shows the insertion of a weft wire 28 for weaving a three-ply fabric. Only the warp wires 2, 3, 4 and 7 are raised by means of the corresponding heddle frames to form the upper sides of the shed as shown in FIG. 9. The remaining warp wires form the lower side of the shed opening 22 when the weft wire 28 is passed therethrough. The wire divider 20 urges all the warp wires required for weaving only the lower fabric half 26 downwardly and out of the shed opening 22. In this way also the warp wires 2*a*, 3*a*, 4*a* and 7*a* of the raised heddle frames are urged out of the shed opening 22.

Figure 10:
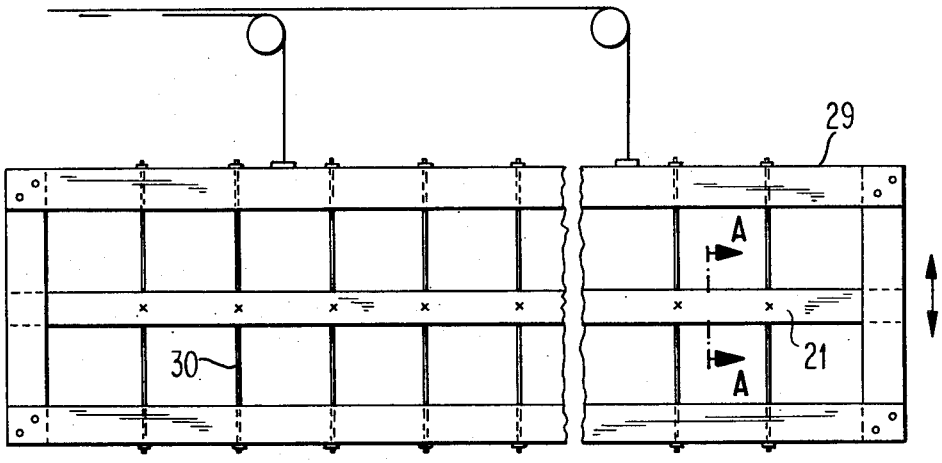
FIG. 10 is a side elevation view of an embodiment of the wire divider designed especially for wide looms such as those required for weaving screens for use in paper making machines.
Figure 10A:
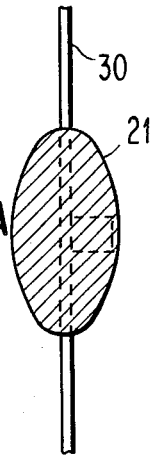
FIG. 10A is a sectional view along the line A—A in FIG. 10.

In FIGS. 1, 3, 5, 7 and 9, the wire divider 20 has been shown with a round cross-section. However, in a modified form as shown in FIGS. 10 and 10A, the wire divider 21 is provided with an oval cross-section having the longer axis thereof vertically disposed in order to impart stability to the wire divider 21 in the vertical direction and to avoid flexing as far as possible. For very broad looms such as those used for weaving screens for paper making machines, the wire divider 21 is preferably mounted within a stable supporting frame 29. The supporting frame surrounds the shed and the wire divider 21 is held in the support frame by steel wires 30 or the like. The supporting frame together with the wire divider moves up and down upon each change of shed.

Figure 11:
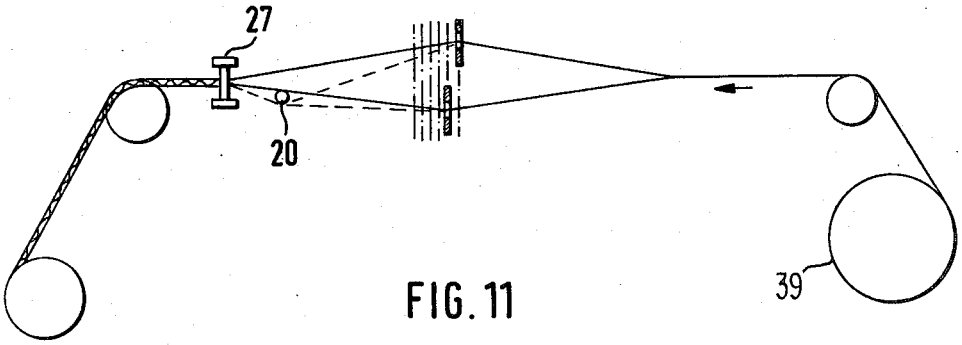
FIG. 11 is a schematic view showing the course of the wrap wires from the reed to the warp beam.
Figure 12:
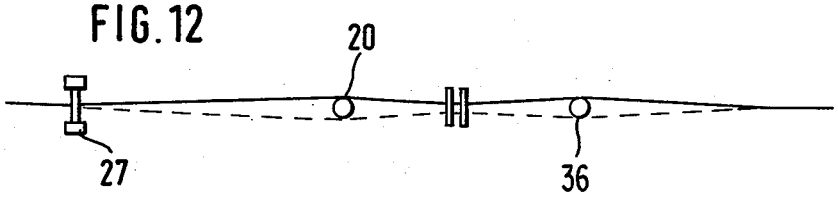
FIG. 12 is a schematic view showing the harness drafting with the additional use of a compensator.
Figure 13:
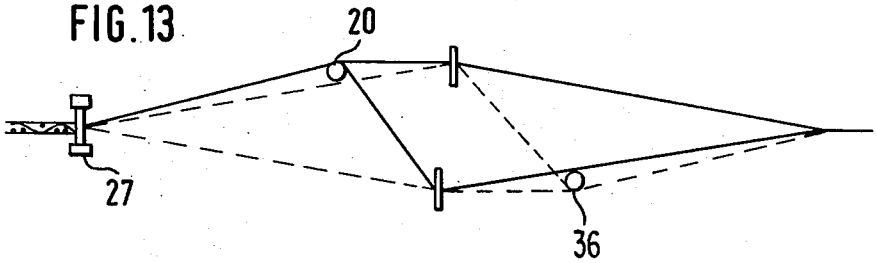
FIG. 13 is a schematic view showing the position of the compensator relative to the position of the wire divider when the wire divider is in the raised position.
Figure 14:
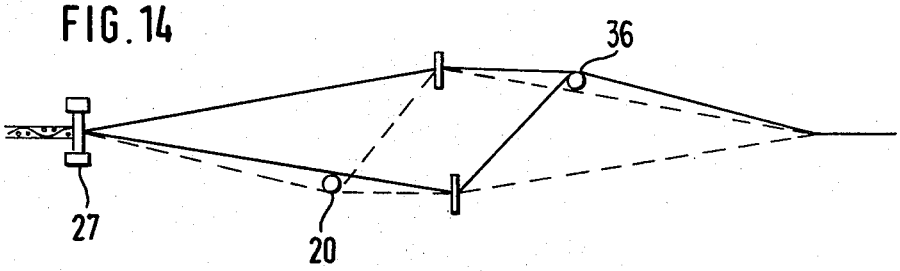
FIG. 14 is a schematic view showing the position of the compensator relative to the position of the wire divider when the wire divider is in the lowered position.

In FIG. 11, the entire course of the warp wire is shown from the warp beam 39 through the shedding apparatus and the reed 27 to the piece beam. From the drawing it is apparent that the paths of the individual warp wires are of different lengths with the paths of the warp wires which extend through the lowered heddle frames with a raised wire divider 20 being the longest. Since on each shed change the wire divider 20 moves in the opposite direction, it may happen that after the next following change of shed different warp wires will have the longest path. The different lengths of the paths of the individual warp wires may result in different tensions in the individual warp wires. These differences in tension can be compensated by a compensator rod 36 as shown in FIGS. 12–14. The compensator rods 36 are similar to the wire dividers 20 but are provided behind the last heddle frame, that is, between the heddle frames and the warp beam. In FIG. 12 the warp wires are introduced so that the warp wires of the lower screen half 26 extending beneath the wire divider 20 are also inserted beneath the compensator 36. The warp wires of the upper screen half 25 extending above the wire divider 20 also extend above the compensator 36. FIGS. 13 and 14 illustrate that with this mode of guiding the warp wires, the compensator 36 is moved in opposition to the wire divider 20, that is, when the wire divider 20 is in its raised position the compensator 36 is in its lowered position and vice versa. The warp wires can also be guided so that the warp wires passing above the wire divider 20 pass underneath the compensator and vice versa. In that case, the compensator 36 is lifted and lowered in line with rather than in opposition to the wire divider 20.

It is additionally pointed out that in FIGS. 11–14 the differences in length of the paths of the individual warp wires are shown in an exaggerated manner for better illustration. In reality the length differences between the normally extending warp wires and the warp wires urged by the warp divider 20 toward the boarder of the shed opening are smaller than shown in the drawing. Moreover, all of the wires participating in the momentary weaving process extend normally and only the warp wires urged away by the wire divider 20 are under higher tension and return to normal tension and participate normally in the weaving process only after the next change of shed.

While the invention has been particularly shown and described with reference to a preferred embodiment thereof, it will be understood by those in the art that various changes in form and details may be made therein without departing from the spirit and scope of the invention.

What is claimed is:

1. A shedding apparatus for weaving of multi-harness fabrics in endless form comprising a reed, a warp beam, a plurality of heddle frames moveable up and down to produce a desired weave with each heddle frame being provided with heddle means adapted for each weave repeat to carry both a warp wire of the upper fabric half and a warp wire of the lower fabric half, a wire divider in the form of a rod extending across the entire fabric width between said heddle frames and said reed, said wire divider being positioned so that all the warp wires of the upper fabric half extend above the wire divider and all of the warp wires of the lower fabric half extend beneath the wire divider so that during weaving of one fabric half the warp wires of the other fabric half with be urged away from the shed by the wire divider, and means for raising and lowering said wire divider upon each change of shed so that said wire divider in its extreme upper and lower positions is disposed adjacent the border of the shed opening produced by the movement of the heddle frames so that said wire divider is raised during the insertion of a weft wire into a shed formed in the warp wires of the upper fabric half out of the shed and said wire divider is lowered during the insertion of a weft wire into a shed formed in the warp wires of the upper fabric half to shift all the warp wires of the lower fabric half out of the shed.

2. A shedding apparatus as set forth in claim 1 further comprising a tension compensator in the form of a rod extending across the entire fabric width between said heddle frames and said warp beam, the warp wires of the upper fabric half being drawn over said compensator rod and the wires of the lower fabric half being drawn below the compensator rod and means for lifting and lowering said tension compensator in the opposite direction to said divider rod each time the divider rod is moved up and down.

* * * * *

UNITED STATES PATENT AND TRADEMARK OFFICE

CERTIFICATE OF CORRECTION

PATENT NO. : 4,463,782

DATED : August 7, 1984

INVENTOR(S) : Georg BOREL

It is certified that error appears in the above-identified patent and that said Letters Patent is hereby corrected as shown below:

Column 6, line 7, change "with" to --will--.

Signed and Sealed this

*Twenty-third* Day of *April 1985*

[SEAL]

*Attest:*

DONALD J. QUIGG

*Attesting Officer*

*Acting Commissioner of Patents and Trademarks*